US007271529B2

(12) United States Patent
Takeda et al.

(10) Patent No.: US 7,271,529 B2
(45) Date of Patent: Sep. 18, 2007

(54) ELECTRON EMITTING DEVICES HAVING METAL-BASED FILM FORMED OVER AN ELECTRO-CONDUCTIVE FILM ELEMENT

(75) Inventors: Toshihiko Takeda, Kanagawa-ken (JP); Keisuke Yamamoto, Kanagawa-ken (JP); Tamaki Kobayashi, Kanagawa-ken (JP); Takuto Moriguchi, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/097,332

(22) Filed: Apr. 4, 2005

(65) Prior Publication Data

US 2005/0225230 A1 Oct. 13, 2005

(30) Foreign Application Priority Data

Apr. 13, 2004 (JP) ..... 2004-117663

(51) Int. Cl.
*H01J 1/30* (2006.01)
*H01J 1/304* (2006.01)
*H01J 19/24* (2006.01)

(52) U.S. Cl. ..... 313/311; 313/495; 313/496; 313/497; 313/310

(58) Field of Classification Search ..... 313/495–497, 313/309–311
See application file for complete search history.

(56) References Cited

U.S. PATENT DOCUMENTS 5,066,883 A 11/1991 Yoshioka et al. ..... 313/309
5,532,544 A 7/1996 Yoshioka et al. ..... 313/310
5,661,362 A 8/1997 Yoshioka et al. ..... 313/309
5,749,763 A 5/1998 Yoshioka et al. ..... 445/51
5,759,080 A 6/1998 Yoshioka et al. ..... 445/51
5,847,495 A 12/1998 Yamanobe et al. ..... 313/310
5,872,541 A 2/1999 Yoshioka et al. ..... 345/74
6,147,449 A 11/2000 Iwasaki et al. ..... 313/495
6,171,162 B1 1/2001 Iwasaki et al. ..... 445/6
6,179,678 B1 1/2001 Kishi et al. ..... 445/24
6,184,610 B1 * 2/2001 Shibata et al. ..... 313/309
6,246,168 B1 6/2001 Kishi et al. ..... 313/495
6,267,636 B1 7/2001 Onishi et al. ..... 445/6
6,334,801 B1 1/2002 Kawade et al. ..... 445/24
6,348,761 B1 2/2002 Nomura et al. ..... 313/495

(Continued)

FOREIGN PATENT DOCUMENTS

EP 0 896 358 A2 2/1999

(Continued)

*Primary Examiner*—Mariceli Santiago
(74) *Attorney, Agent, or Firm*—Fitzpatrick, Cella, Harper & Scinto

(57) ABSTRACT

An image display apparatus including a rear plate and a face plate disposed opposite to each other, the rear plate being equipped with a plurality of electron-emitting devices, each provided with a pair of electrodes and an electroconductive film including an electron-emitting region disposed between the electrodes, the face plate being equipped with a phosphor for displaying an image and a film exposed on a surface of the phosphor, the film comprising a metal or a metal compound material. A film comprising the same metal or the same metal compound material as the metal or the metal compound material constituting the film exposed on the surface of the phosphor is formed on each of the electro-conductive films of the plurality of electron-emitting devices to have a thickness in a range from 0.2 nm to 4.5 nm.

10 Claims, 4 Drawing Sheets

U.S. PATENT DOCUMENTS

| | | | | |
|---|---|---|---|---|
| 6,379,211 | B2 | 4/2002 | Onishi et al. | 445/73 |
| 6,459,207 | B1 | 10/2002 | Nomura et al. | 315/169.3 |
| 6,555,957 | B1 | 4/2003 | Nomura et al. | 313/495 |
| 6,608,437 | B1 | 8/2003 | Kishi et al. | 313/495 |
| 6,617,773 | B1 | 9/2003 | Yamamoto et al. | 313/310 |
| 6,633,118 | B1 | 10/2003 | Yamamoto et al. | 313/495 |
| 6,642,649 | B1 | 11/2003 | Yamamoto et al. | 313/495 |
| 6,731,060 | B1 | 5/2004 | Yamamoto et al. | 313/495 |
| 6,802,753 | B1 | 10/2004 | Ando et al. | 445/6 |
| 6,831,401 | B1 | 12/2004 | Yamamoto et al. | 313/495 |
| 6,876,156 | B1 | 4/2005 | Yamamoto et al. | 315/169.3 |
| 6,896,571 | B2 | 5/2005 | Mizuno et al. | 445/24 |
| 6,905,384 | B2 | 6/2005 | Miyazaki et al. | 445/25 |
| 2002/0068496 | A1 | 6/2002 | Onishi et al. | 445/6 |
| 2003/0222570 | A1 | 12/2003 | Kishi et al. | 313/495 |
| 2005/0040751 | A1 | 2/2005 | Yamamoto et al. | 313/311 |
| 2005/0164591 | A1 | 7/2005 | Mizuno et al. | 445/24 |
| 2005/0179360 | A1* | 8/2005 | Okamoto et al. | 313/495 |
| 2005/0194912 | A1 | 9/2005 | Kobayashi et al. | 315/169.1 |
| 2005/0225230 | A1 | 10/2005 | Takeda et al. | 313/496 |
| 2005/0236965 | A1 | 10/2005 | Yamamoto et al. | 313/496 |
| 2005/0258734 | A1 | 11/2005 | Nukanobu et al. | 313/495 |
| 2005/0282458 | A1 | 12/2005 | Takeda et al. | 445/46 |
| 2006/0003660 | A1 | 1/2006 | Kobayashi et al. | 445/5 |

FOREIGN PATENT DOCUMENTS

| | | |
|---|---|---|
| EP | 1 035 559 A2 | 9/2000 |
| JP | 7-65699 | 3/1995 |
| JP | 9-102267 | 4/1997 |
| JP | 9-330648 | 12/1997 |
| JP | 2000-21292 | 1/2000 |
| JP | 2000-251621 | 9/2000 |
| JP | 2001-229828 | 8/2001 |
| JP | 2002-343232 | 11/2002 |

* cited by examiner

ELECTRON EMITTING DEVICES HAVING METAL-BASED FILM FORMED OVER AN ELECTRO-CONDUCTIVE FILM ELEMENT

BACKGROUND OF THE INVENTION

1. Field of the Invention

The present invention relates to an image display apparatus and a method for manufacturing the same. More particularly, the present invention relates to an image display apparatus in which a rear plate equipped with a plurality of electron-emitting devices, and a face plate equipped with a phosphor which displays an image by being irradiated by electrons from the electron-emitting devices are disposed opposite to each other, and a method for manufacturing the same.

2. Related Background Art

There is conventionally known an image display apparatus provided with a rear plate and a face plate which are opposed to each other to be seal-bonded (see, for example, Japanese Patent Application Laid-Open No. 2000-251621). The rear plate is equipped with a plurality of electron-emitting devices in each of which an electroconductive thin film including an electron-emitting region spans a pair of device electrodes. The face plate is equipped with a phosphor for displaying an image by being irradiated by electron beams from the electron-emitting devices, and a metal-back formed on the surface of the phosphor.

On the other hand, the following methods are known as a method for manufacturing an image display apparatus (see, for example, Japanese Patent Application Laid-Open No. 2001-229828). One of the methods performs the following processes. Bake processing is performed to a face plate provided with a phosphor and a rear plate provided with electron-emitting devices for discharging impurity gases contained in these plates. A first getter processing is performed to one of, or both of the face plate and the rear plate, which have received the bake processing, and then a film of a getter material such as barium is made to adhere to the plates to be a thickness of 5 to 500 nm. After that, electron beam irradiation processing is performed to the plate processed by the first getter processing to discharge impurity gases. Moreover, a second getter processing is performed to one of, or both of the face plate and the rear plate to make a film of a getter material such as barium adhere to the plates again to be a thickness of 5 to 500 nm. After that, the face plate and the rear plate are opposed to each other to be seal-bonded. Then, the inside of an obtained image display apparatus is made to be a high vacuum state of $10^{-6}$ Pa or less. The other method performs each of the processing described above in the order of the bake processing, the fist getter processing, the seal bonding and so forth.

However, the conventional image display apparatus disclosed in the Japanese Patent Application Laid-Open No. 2000-251621 has a problem that there appear the changes of electric currents discharged from respective electron-emitting devices when the image display apparatus has performed image displaying over a long period of time of thousands of hours. Moreover, in case of the conventional manufacturing methods disclosed in the Japanese Patent Application Laid-Open No. 2001-229828, it is indispensable to form the film of the getter material to be a thickness at which the film functions as a getter. In the case where the image forming apparatus is formed by forming the film of the getter material of such a thickness onto the electron-emitting devices on the rear plate, there is produced an evil such that the electron-emitting devices do not work as the electron-emitting devices, or that the performance of the electron-emitting devices is remarkably deteriorated because reactive currents which do not contribute to electron discharging increase. Accordingly, the film of the getter material is actually formed only on the face plate which does not produce such a problem, and forming the film even on a rear plate is not performed.

Now, the changes of the electric currents in the conventional image display apparatus do not matter when all the electron-emitting devices that exist in one image forming apparatus change uniformly in the same way, for example, the electric currents uniformly increase or decrease. As a result of the present inventors' zealous research, it was found that the changes varied depending on how each electron-emitting device was driven.

To put it concretely, discharged currents increase in the electron-emitting devices which have been driven for longer times. Moreover, in the case where the drive time is the same, the discharged current increases in the electron-emitting device which performed brighter display. That is, there is a tendency of the increases in the electric currents of becoming larger in an electron-emitting device which has discharged more electrons.

Since all the electron-emitting devices cause the same increases in current when an image having the brightness over the whole screen is displayed, for example, the whole screen is displayed in white, the changes are only one which makes the whole screen brighter uniformly. However, in the image display apparatus, which is ordinarily required to display images changing from moment to moment, the homogeneity of brightness is damaged.

Moreover, in the case where a still image has been displayed for a long time in, e.g., an output screen of a computer, a part where a bright image has been displayed becomes still brighter by an increase of discharged currents, and a part where a black image has been displayed maintains the state as it is. Consequently, the distribution of brightness tends to become remarkable.

Even if the displays of different images after that are performed, the increases of the electric currents produced by the difference in the display images are not removed immediately. Then, the so-called burn-in phenomenon, in which the distribution of brightness produced by the image display till that time remains as it is, is produced, and the image display apparatus becomes one having remarkably damaged homogeneity.

As a result of a further detailed research, the present inventors found that the increases of the discharged currents are accompanied not only by the changes of the absolute values of the electric currents but also by the rises of electron discharging efficiency.

The electron discharging efficiency cited here is expressed by a ratio of an electric current which flows between device electrodes when a fixed voltage is imposed between the device electrodes of an electron-emitting device (hereinafter referred to as an "device current") and an electric current discharged into the vacuum from an electron-emitting region (hereinafter referred to as a "discharge current"). It is needless to say that an electron-emitting device having a small device current and a large discharge current, i.e. a high electron discharging efficiency, is preferable as an image display apparatus.

In the case where a discharge current increases owing to the above-mentioned image display, since the increase in the device current is not large in comparison with the increase in the discharge current, the electron discharging efficiency of the electron-emitting device itself rises as a result. Like the above-mentioned increase of the electric current, by a drive for a longer time or by a brighter image display, this change also becomes remarkable, and further a burn-in phenomenon is also produced.

Both of these increases in the electric current and the electron discharging efficiency became the factor which deteriorates the homogeneity of a display image, and they have been serious obstacles for realizing an image display apparatus which is required to perform a high definition image display over a long period of time.

SUMMARY OF THE INVENTION

It is an objective of the present invention to provide an image display apparatus which can keep the homogeneity of brightness over a long period of time.

In one aspect of the present invention, there is provided an image display apparatus including a rear plate and a face plate disposed opposite to each other, the rear plate being equipped with a plurality of electron-emitting devices, each provided with a pair of electrodes and an electroconductive film including an electron-emitting region disposed between the electrodes, the face plate being equipped with a phosphor for displaying an image by being irradiated by electrons from the electron-emitting devices and a film exposed on a surface of the phosphor, the film comprising a metal or a metal compound material, the apparatus characterized by a film comprising the same metal or the same metal compound material as the metal or the metal compound material constituting the film exposed on the surface of the phosphor, the film being formed on each of the electroconductive films of the plurality of electron-emitting devices to have a thickness in a range from 0.2 nm to 4.5 nm.

Moreover, in another aspect of the present invention, there is provided a method for manufacturing an image display apparatus including a rear plate and a face plate disposed opposite to each other, the rear plate being equipped with a plurality of electron-emitting devices, each provided with a pair of electrodes and an electroconductive film including an electron-emitting region disposed between the electrodes, the face plate being equipped with a phosphor for displaying an image by being irradiated by electrons from the electron-emitting devices and a film exposed on a surface of the phosphor, the film comprising a metal or a metal compound material, the method characterized by the steps of forming a film comprising the same metal or the same metal compound material as the metal or the metal compound material constituting the film exposed on the surface of the phosphor, the film being formed on each of the electroconductive films of the electron-emitting devices to have a thickness in a range from 0.2 nm to 4.5 nm, and performing seal bonding of the rear plate and the face plate after the forming of the film.

BRIEF DESCRIPTION OF THE DRAWINGS

FIGS. 2A and 2B are schematic views showing the example of fundamental composition of an electron-emitting device used for the image display apparatus of FIG. 1, in which FIG. 2A is a sectional view and FIG. 2B is a plane view;

DETAILED DESCRIPTION OF THE PREFERRED EMBODIMENTS

Figure 1:
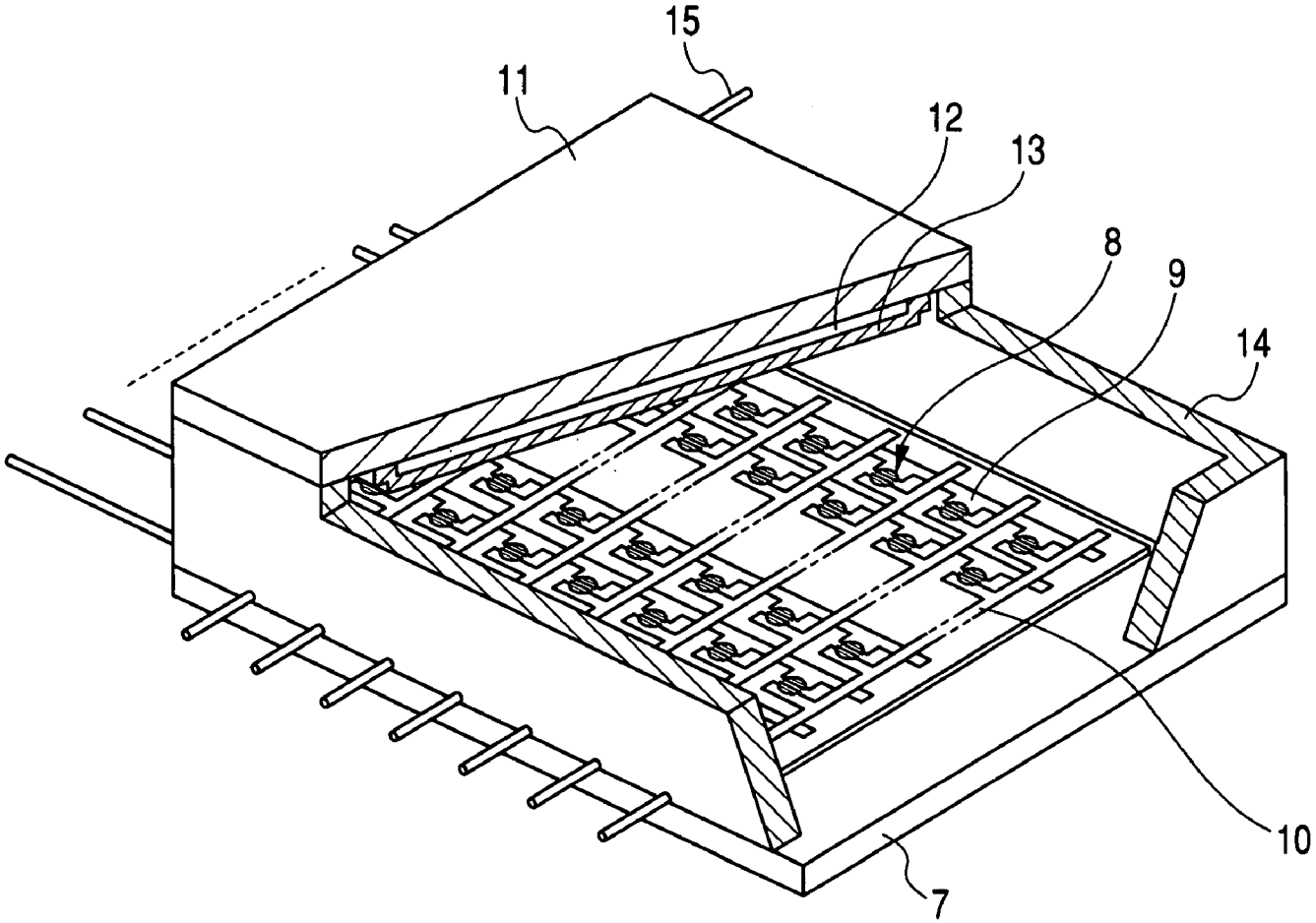
FIG. 1 is a partially broken perspective view showing an example of an image display apparatus according to the present invention.

As a result of present inventors' zealous research with regard to the causes which produce the increase of the electric current and the rise of the electron discharging efficiency, on the electron-emitting device which has caused the increase of the electric current and the rise of the electron discharging efficiency in the image display apparatus having the exposed metal-back, adhesion of the metal or the metal compound material which constitutes the metal-back was ascertained. Moreover, it is also ascertained that the adhesion of the metal or the metal compound material did not exist on the electron-emitting devices corresponding to the portion which continued displaying only a black image or a very dark image.

Accordingly, by depositing various metals or metal compounds on electron-emitting devices in a vacuum apparatus, it was ascertained that a discharge current in early stages of a drive increased and an initial efficiency was high in the case of depositing a material having the so-called low work function.

From the above results, the following situation can be considered. That is, the performance and the characteristics of an electron-emitting device are very sensitive to the materials constituting the electron-emitting region thereof, or to the state of the electron-emitting region. In the case where the electron-emitting device has been used over a long period of time as an image display apparatus, the constituent materials of the metal-back disposed to be exposed in the sate of facing to the electron-emitting device fall (scatter) and are attached on the electron-emitting device to change the characteristics of the electron-emitting device. Moreover, there is a case where a film of a getter material is formed on the surface of the metal-back for making the inside of the image display apparatus to be a high vacuum. In such a case, it is considerable that the exposed getter material falls and adheres onto the electron-emitting device to change the characteristics of the electron emitting device.

The present invention was made on the basis of the inventors' knowledge described above. A first aspect of the present invention is to provide an image display apparatus including a rear plate and a face plate disposed opposite to each other, the rear plate equipped with a plurality of electron-emitting devices, each provided with a pair of electrodes and an electroconductive film including an electron-emitting region disposed between the electrodes, the face plate equipped with a phosphor for displaying an image by being irradiated by electrons from the electron-emitting devices and a film exposed on a surface of the phosphor, the film comprising a metal or a metal compound material, the apparatus characterized by a film comprising the same metal or the same metal compound material as the metal or the metal compound material constituting the film exposed on the surface of the phosphor, the film formed on each of the electroconductive films of the plurality of electron-emitting devices to have a thickness in a range from 0.2 nm to 4.5 nm.

Moreover, a second aspect of the present invention is a method for manufacturing an image display apparatus including a rear plate and a face plate disposed opposite to each other, the rear plate equipped with a plurality of electron-emitting devices, each provided with a pair of electrodes and an electroconductive film including an electron-emitting region disposed between the electrodes, the face plate equipped with a phosphor for displaying an image by being irradiated by electrons from the electron-emitting devices and a film exposed on a surface of the phosphor, the film comprising a metal or a metal compound material, the method characterized by the steps of forming a film comprising the same metal or the same metal compound material as the metal or the metal compound material constituting the film exposed on the surface of the phosphor, the film formed each of on the electroconductive films of the electron-emitting devices to have a thickness in a range from 0.2 nm to 4.5 nm, and performing seal bonding of the rear plate and the face plate after the forming of the film.

According to the present invention, because the film comprising the same metal or the same metal compound as the metal or the metal compound which is a cause of changing the characteristics of the electron-emitting devices by falling and adhering onto the electroconductive films (electroconductive members) including the electron-emitting regions of the electron-emitting devices owing to the display of images over a long period is provided on the electroconductive films (electroconductive members) of the electron-emitting devices in advance, it is possible to prevent the large changes of the characteristics of the electron-emitting devices, even if the metal or the metal compound falls and adheres onto the electroconductive films. Consequently, it can be possible to maintain an image display having a uniform brightness over a long period of time. Moreover, because the film comprising the metal or the metal compound has a thickness in a range from 0.2 nm to 4.5 nm, which is thinner than the film of the getter material, no evils are caused by the provision of the film.

Hereafter, the present invention is described still in detail with reference to the attached drawings.

Figure 2A:
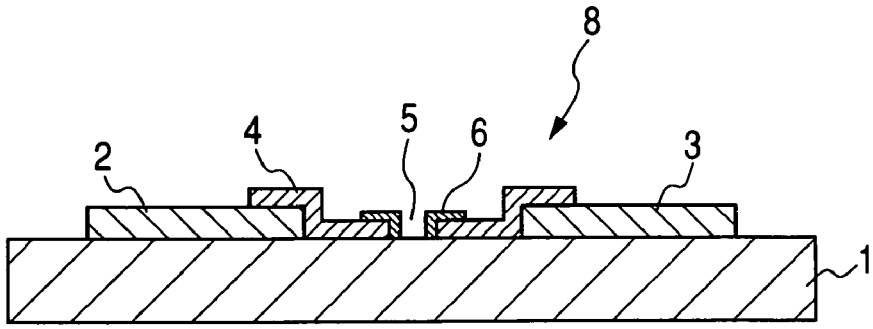
Figure 2B:
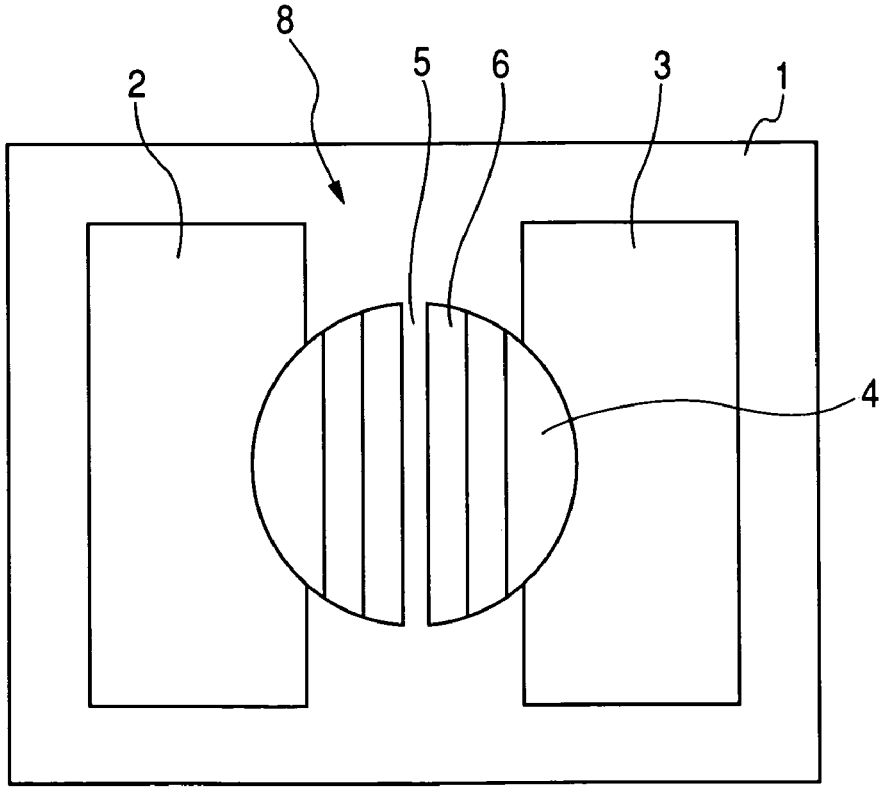

FIG. 1 is a partially broken perspective view showing an example of an image forming apparatus according to the present invention, and FIGS. 2A and 2B are schematic diagrams showing an example of the basic configuration of an electron-emitting device to be used in the image forming apparatus of FIG. 1, in which FIG. 2A is a sectional view and FIG. 2B is a plan view.

As shown in FIG. 1, a rear plate 7 is one provided with an electron source substrate 1 on which many electron-emitting devices 8 are formed. Each of the electron-emitting devices 8 is, as shown in FIGS. 2A and 2B, provided with a pair of device electrodes 2 and 3 on the electron source substrate 1, and an electroconductive film 4 including an electron-emitting region 5, which electroconductive film 4 spans a range between the device electrodes 2 and 3. Moreover, a film 6 comprising a metal or a metal compound is provided in an adjoining region of the electron-emitting region 5, namely on the electroconductive film 4 forming the electron-emitting region 5 in the shape of a gap in it. The film 6 will be described later.

Y-direction wiring (under wiring) 9 is formed on the electron source substrate 1 to be connected with the device electrodes 3, one of the device electrodes of the electron-emitting device 8. Moreover, X-direction wiring (over wiring) 10 connected to the other device electrodes 2 through contact holes (not shown) formed in insulating layers (not shown) is provided in the direction intersecting the Y-direction wiring 9 with the insulating layers put between them. The Y-direction wiring 9 and the X-direction wiring 10 are desired to have a low resistance so that almost equal voltages may be supplied to the electron-emitting devices 8, and the material, the film thicknesses, the wire widths and the like of the wiring 9 and 10 are set suitably. Moreover, as an example of the method of forming the Y-direction wiring 9, the X-direction wiring 10 and the insulation layers, a combination of a printing method or the sputtering method and a photolithography technology, and the like can be used. Each electron-emitting device is adapted to be able to be selectively driven by applying a voltage between the device electrodes 2 and 3 through the Y-direction wiring 9 and the X-direction wiring 10.

A phosphor 12, a metal-back 13 and the like are formed on the inner surface of a transparent insulating face plate 11 comprising a glass or the like to be opposed to the rear plate 7 including the electron source substrate 1. A reference numeral 14 denotes a supporting frame. The rear plate 7, the supporting frame 14 and the face plate 11 are seal-bonded with frit glass or the like, and they constitute a panel-like airtight container.

A space surrounded by the rear plate 7, the supporting frame 14 and the face plate 11 is made to be in a vacuum atmosphere. Although the formation of the vacuum atmosphere can be also performed by providing an exhaust pipe to the rear plate 7 or the face plate 11 to seal the exhaust pipe after exhausting the gas in the space to be a vacuum, the formation of the vacuum atmosphere can be easily performed by performing the seal-bonding of the rear plate 7 and the face plate 11 performed with the supporting frame 14 put between them in a vacuum chamber.

The display of an image can be performed as follows. That is, connecting a drive circuit for driving the electron-emitting devices 8 to the image display apparatus, applying a voltage between desired device electrodes 2 and 3 through the Y-direction wiring 9 and the X-direction wiring 10 to generate electrons from the electron-emitting region 5 (see FIGS. 2A and 2B), and applying a high voltage to the metal-back 13, being an anode electrode, from a high-voltage terminal 15 to accelerate electron beams to make the electron beams collide with the phosphor 12. Moreover, a panel-like airtight container of a large area which has a sufficient strength to the atmospheric pressure can be configured by mounting not shown supporting members called as spacers between the face plate 11 and the rear plate 7.

As clearly shown in FIGS. 2A and 2B, the electron-emitting device 8 provided with the electroconductive film 4 spanning the range between the pair of device electrodes 2 and 3, which electroconductive film 4 has the electron-emitting region 5, is called as a surface conduction electron-emitting device. According to the fundamental characteristics of the surface conduction electron-emitting device, the electrons discharged from the electron-emitting region 5 are controlled in accordance with the peak value and the width of a pulse-shaped voltage applied between the opposing device electrodes 2 and 3, and the amount of the electric current is controlled also according to the intermediate value of the pulse-shaped voltage when the pulse-shaped voltage is equal to a threshold voltage or more. Consequently, a half-tone display can be preformed. Moreover, in the case where a lot of electron-emitting devices 8 is arranged as the present embodiment, for example, by determining a selected line by a scanning line signal transmitted to the Y-direction wiring 9 and by supplying an information signal to each wire of the X-direction wiring 10 to apply the pulse-shaped voltage to the respective electron-emitting devices 8 suitably, it becomes possible to apply a voltage to an arbitrary electron-emitting device 8 suitably, and an arbitrary electron-emitting device 8 can be turned on.

Furthermore, the configuration of the electron-emitting device 8 is described.

As the electron source substrate 1, there can be used silica glass, glass including reduced amount of impurities such as Na, soda lime glass, soda lime glass including a $SiO_2$ film laminated on the glass by the sputtering method or the like, ceramics such as alumina, a Si substrate and the like.

As a material of the pair of device electrodes 2 and 3, general electroconductive materials can be used. For example, the material can be selected from metals or alloys such as Ni, Cr, Au, Mo, W, Pt, Ti, A, Cu, Pd, printed conductors composed of metals or metal oxides such as Pd, Ag, Au, $RuO_2$, Pd—Ag and glass, transparent conductors such as $In_2O_3$—$SnO_2$, semiconductor materials such as polysilicon, and the like.

The interval between the device electrodes 2 and 3, the lengths of the device electrodes 2 and 3 (the lengths in the direction perpendicular to the opposed direction of the device electrodes 2 and 3), the shape of the electroconductive film 4, and the like are designed in consideration of the form or the like in which the electron-emitting device is applied. The interval between the device electrodes 2 and 3 is preferably within a range from hundreds of nanometers to hundreds of micrometers, and the interval is more preferably within a range from several micrometers to several tens millimeters in consideration of the voltage or the like applied between the device electrodes 2 and 3.

The lengths of the device electrodes 2 and 3 are preferably within a range from several micrometers to hundreds of micrometers in consideration of the resistance values of the electrodes and the electronic discharging characteristics. The film thicknesses of the device electrodes 2 and 3 are preferably within a range from several tens of nanometers to several micrometers.

Incidentally, although the electron-emitting device is composed of the lamination in the order of the device electrodes 2 and 3 and the electroconductive film 4 from the side of the electron source substrate 1 in the example shown in FIGS. 2*a* and 2B, the electron-emitting device can have a configuration composed of the lamination in the order of the electroconductive film 4 and the device electrodes 2 and 3.

The electroconductive film 4 is especially preferably a fine particle film composed of fine particles in order to acquire good electron source characteristics. Although the film thickness of the electroconductive film 4 is suitably selected according to the step coverage between the device electrodes 2 and 3, a resistance value, the forming conditions to be mentioned later, and the like, the film thickness is preferably within a range from 5 nm to 50 nm.

Moreover, in order to make a forming process easy to perform in the state before the forming process, which will be mentioned later (state before the formation of the electron-emitting region 5), it is preferable that the resistance value of the electroconductive film 4 has a certain degree of magnitude. To put it concretely, the resistance value is preferably within a range from $10^3$ Ω/□ to $10^7$ Ω/□. On the other hand, since the electroconductive film 4 after the forming (after forming the electron-emitting region 5) preferably has a low resistance in order that a sufficient voltage can be applied to the electron-emitting region 5 through the device electrode 2 and 3, the electroconductive film 4 is preferably formed as a thin film of a metal oxide having a sheet resistance value equal to $10^3$ Ω/□ to $10^7$ Ω/□ or less, and is formed to be a metal film having lower resistance by being reduced after the forming processing. Consequently, the lower limit of the resistance value of the electroconductive film 4 in a final state is not especially limited. Incidentally, the resistance value of the electroconductive film 4 here means a sheet resistance value measured in the region which does not include the electron-emitting region 5.

As the material of the electroconductive film 4, metals such as Pd, Pt, Ru, Ag and Au, oxides such as PdO, $SnO_2$ and $In_2O_3$, borides such as $HfB_2$, carbides such as TiC and SiC, nitrides such as TiN, semiconductors such as Si and Ge, carbon and the like can be cited. As the formation method, various techniques such as the ink jet applying method, the spin coat method, the dipping method, the vacuum deposition method, the sputtering method and the like are applicable.

Among the materials of the electroconductive film 4 mentioned above, PdO is a preferable material from the following reasons. That is, PdO can be easily formed to be a thin film by performing the burning of an organic Pd compound in the air. Since PdO is a semiconductor, PdO has a relatively low electric conductivity, and consequently has a wide process margin of the film thickness for obtaining the sheet resistance value within the above-mentioned range. Because PdO can be easily reduced to be a metal Pd after the formation of the electron-emitting region 5, the film resistance after the formation of the electron-emitting region 5 can be easily decreased, and the heat resisting property of the electroconductive film 4 also increases.

The electron-emitting region 5 is a fissure (nano-fissure) portion of a high resistance formed in a part of the electroconductive film 4 by the forming process, which will be mentioned later, and the form thereof depends on the film thickness, the film quality and the material of the electroconductive film 4, a technique such as energization forming, which will be mentioned later, and the like.

Figure 3A:
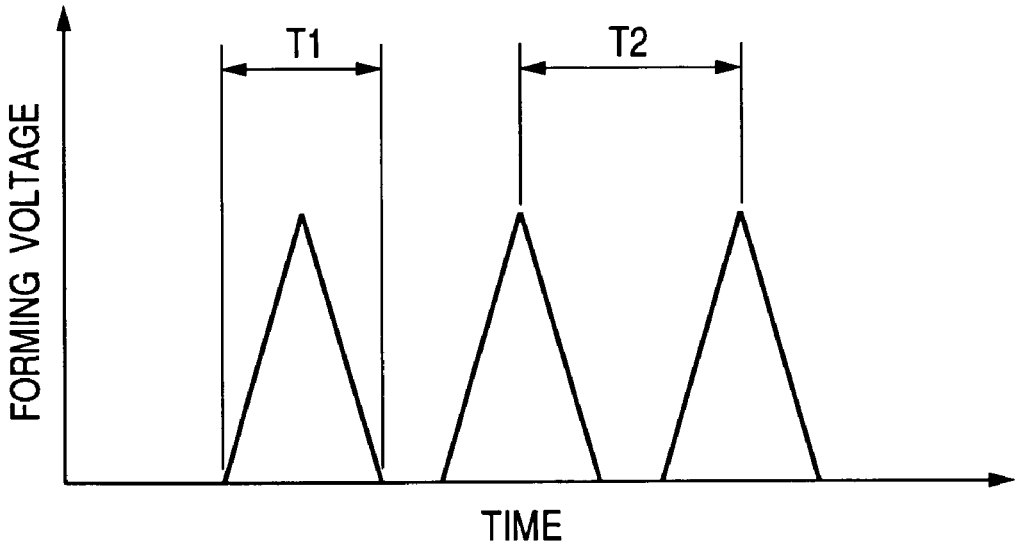
FIGS. 3A and 3B are views showing examples of application voltage waveforms to be used for forming.
Figure 3B:
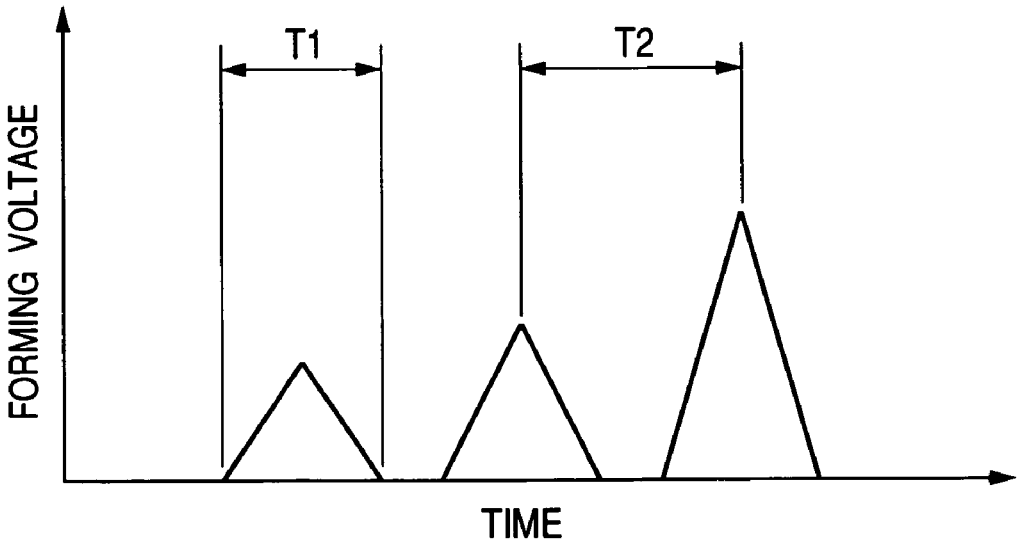

The forming process is performed by applying a voltage from an external power supply under a vacuum atmosphere. By energizing between the device electrodes 2 and 3, the electroconductive film 4 is partially destroyed, deformed or changed in quality, and consequently the electron-emitting region 5 in the shape of a fissure in the state of having an electrically high resistance is formed. As the voltage to be applied, a pulse waveform is generally used. There are a case where pulses having peak values being a fixed voltage are applied as shown in FIG. 3A, and a case where pulses having peak values increasing in order as shown in FIG. 3B. In FIG. 3A, the pulse width T1 is generally almost within a range from 1 μsec to 10 msec and the pulse interval T2 is generally almost within a range from 10 μsec to 10 msec, and further the peak voltage (peak voltage at the time of forming) is suitably selected according to the quality of the material of the electroconductive film 4 and the like. Moreover, in FIG. 3B, the pulse width T1 and the pulse interval T2 are the same as those in FIG. 3A, respectively, and the amounts of the peak values and the increasing amounts of the peak values are suitably selected according to the quality of the material of the electroconductive film 4 and the like.

When the electroconductive film 4 receives energizing heating under an atmosphere containing some gas having reduction nature such as hydrogen in the case where a metal oxide is used as the electroconductive film 4, the electron-emitting region 5 can be formed while reducing the electroconductive film 4. The electroconductive film 4 including a metal oxide as the principal component at the beginning becomes the one including a metal as the principal component after the end of forming, and consequently the parasitic resistance at the time of driving an electron-emitting device can be decreased. Moreover, a process for reducing the electroconductive film 4 completely also can be added.

The forming processing can be ended at the following time point. That is, a voltage having a magnitude which does not destroy and deform the electroconductive film 4 locally, for example, a pulse voltage of about 0.1 V, is inserted between the pulses for forming to measure a device current (an electric current between the device electrodes 2 and 3). Thereby, a resistance value is obtained, and the forming processing can be ended at the time point when the resistance value shows, for example, a value equal to 1000 times or more of the resistance before the forming processing.

Next, a description is given to an activation process for disposing a film including carbon and/or a carbon compound as the principal component, which film is not shown in FIGS. 2A and 2B, on the electroconductive film 4 in the adjoining region of the electron-emitting region 5 formed by the forming process.

The activation process is performed by, for example, introducing the gas of a suitable carbon compound into a vacuum, and by applying a pulse voltage between the device electrodes 2 and 3. By performing the activation process, the discharge current discharged from a region near the electron-emitting region 5 can be increased considerably.

Since the preferable gas pressure of the carbon compound in the activation process varies according to the use of the electron source substrate, the kind of the carbon compound, and the like, the preferable gas pressure is suitably set according to circumstances.

As suitable carbon compounds, there can be cited aliphatic hydrocarbons such as alkane, alkene and alkyne, aromatic hydrocarbons, alcohols, aldehydes, ketones, amines, organic acids such as phenol, carvone and sulfonic acid, and the like. Although the pressure of the carbon compound to be introduced is influenced a little according to the shape of a vacuum apparatus, the member used for the vacuum apparatus, the kind of the carbon compound, and the like, the pressure is preferably within almost a range from $1\times10^{-5}$ Pa to $1\times10^{-2}$ Pa in case of a trinitrile, for example.

The film which consists of carbon and/or carbon compound is formed in the electron-emitting region 5 formed by the forming process and on the electroconductive film 4 around the electron-emitting region 5 from the carbon compound which exists in the atmosphere by the processing of applying a pulse voltage between the device electrodes 2 and 3 under the existence of the carbon compound.

Figure 4A:
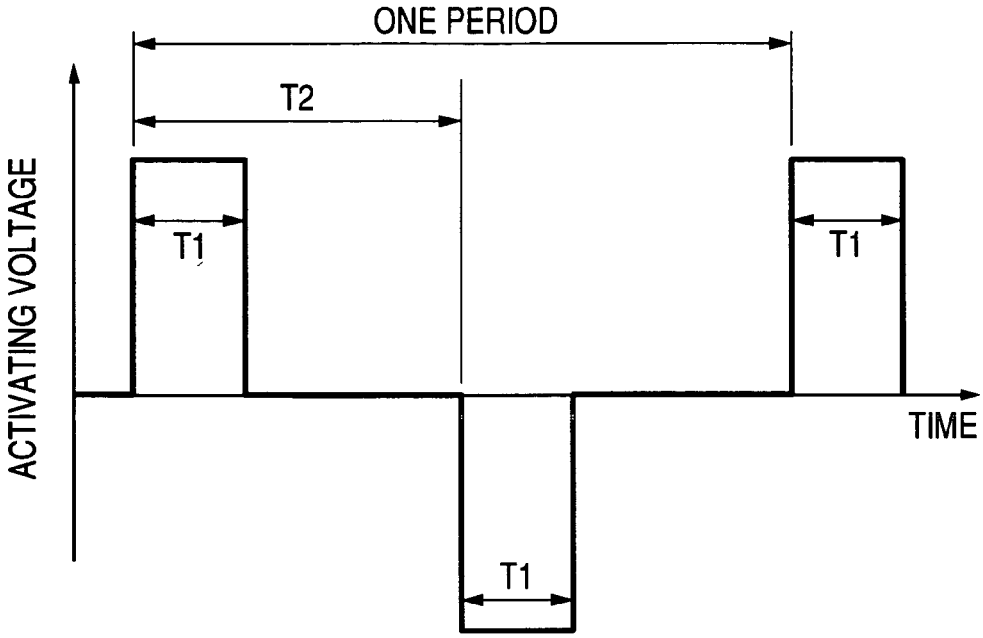
FIGS. 4A and 4B are views showing examples of application voltage waveforms to be used for activation.
Figure 4B:
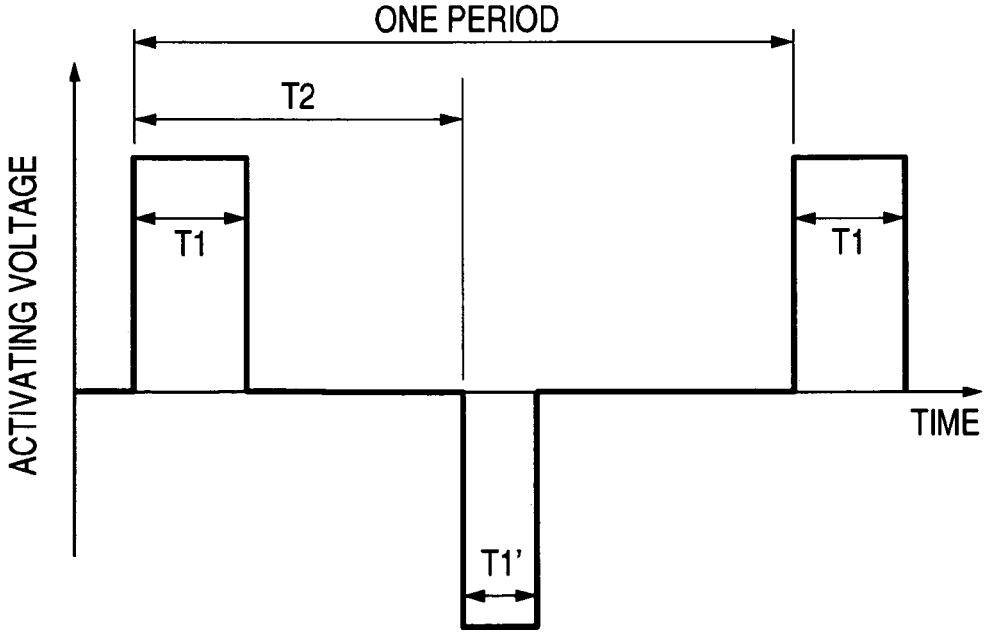

FIGS. 4A and 4B show preferable examples of application voltage waveforms used at the activation process, and the maximum voltage value to be applied is usually suitably selected within a range from 10 V to 20 V. In FIG. 4A, a reference sign T1 denotes pulse widths of the positive and negative voltage waveforms, and a reference sign T2 denotes a pulse interval. The voltage values are set to have the absolute values of the positive ones and the negative one which are equal to one another. Moreover, in FIG. 4B, reference signs T1 and T1' denote pulse widths of the positive and negative voltage waveforms, respectively, and a reference sign T2 denotes a pulse interval. The pulse width T1 is longer than the pulse width T1', and the voltage values are set to have the absolute values of the positive ones and the negative one which are equal to one another.

A device current or a discharge current (an electric current discharged as electrons from the electron-emitting region 5) is measured while the activation process is performed, and the activation process can be ended at the time when the device current or the discharge current becomes a desired value. Incidentally, also the pulse widths, the pulse intervals, the pulse peak values and the like of the pulse voltages to be applied are suitably selected according to the kind, the gas pressure and the like of the carbon compound.

As shown in FIGS. 2A and 2B, the film 6 provided in the adjoining region to the electron-emitting region 5 is usually provided as an adjunct after the activation process described above, and the film 6 in the present example is comprising the same material as that of the metal-back 13 (see FIG. 1), which is exposed on the surface of the phosphor 12 formed on the face plate 11. That is, the metal-back 13 is an electroconductive film comprising a metal or a metal compound material, and the film 6 in the present example is comprising the same metal or the same metal compound material as that constituting the metal-back 13. Consequently, even if the metal or the metal compound material constituting the metal-back 13 fell and adhered onto the adjoining region to the electron-emitting region 5 of the electron-emitting device 8 owing to the image display over a long period, the changes of the characteristics of the present electron-emitting device 8, which has an increased discharge current and improved initial efficiency by means of the previously formed film 6 comprising the same metal or the same metal compound materials as that of the metal-back 13, can be significantly suppressed in comparison with the changes in the case where the film 6 is not previously provided.

Although the film 6 in the present example is comprising the same metal or the metal compound material as the constituent material of the metal-back 13 as described above, the same metal or the same metal compound material as the metal or the metal compound material constituting a getter material is used as the film 6 in the case where the film (not shown) of the getter material comprising the metal or the metal compound material is provided on the surface of the metal-back 13 and the supplemental film of the getter material is exposed.

Aluminum generally used by a CRT is used as the constituent material of the metal-back 13, and barium, titanium or the like is used as the getter material. Accordingly, in the case where the metal-back 13 is exposed on the surface of the phosphor 12 of the face plate 11, the same aluminum as the constituent material of the metal-back 13 is used as the film 6. In the case where the film of the getter material is further provided to be exposed on the surface of the phosphor 12, the same barium, the same titanium or the like as that of the getter material is used as the film 6.

In the case of the electron-emitting device 8 formed through the activation process, the formation of the film 6 is performed after the activation process. In the case where the constituent material of the film 6 is the same as that of the metal-back 13, the formation of the film 6 can be performed by the same technique as that of the formation of the metal-back 13, for example, by a vacuum film formation technique such as the sputtering method, the vacuum deposition method or the like. Moreover, in the case where the constituent material of the film 6 is the same as that of the getter material, the film 6 can be provided as an adjunct by the same technique as that of the getter material, that is, the film 6 can be provided as the adjunct by the sputtering method, for example, in case of an un-evaporating type, and the film 6 can be provided as the adjunct by the performance of energization heating to flash the material in case of an evaporating type, for example. Moreover, as materials applicable to the film 6, there can be cited metals such as chromium, zinc and molybdenum and their compounds, alkali metals such as cesium, kalium and lithium and their compounds besides the aluminum, barium and titanium described above. Although the above-mentioned vacuum film formation technique is applicable as the formation method of the film 6, since the film 6 is a very thin film having a high reactivity, it is preferable that the film formation method is by the vacuum consistent process without exposure to the air after the formation of the film 6.

It is necessary for the film 6 to have a thickness within a range from 0.2 nm to 4.5 nm in order not to produce the evil such that the electron-emitting device loses the function as an electron-emitting device, or that the performance of the electron-emitting device is remarkably deteriorated owing to the increase of the reactive current which does not contribute to the discharge of electrons. In the case where the thickness of the film 6 is smaller than 0.2 nm, it is difficult to obtain the formation effect of the film 6. In the case where the thickness exceeds 4.5 nm, it becomes easy to cause the evil such that the function as the electron-emitting device is lost, or that the deterioration of the performance is caused by the increase of the reactive current. The preferable thickness of the film 6 is within a range from 0.3 nm to 4 nm. If the thickness of the film 6 is within this range, the film 6 can be provided as an adjunct over the whole surface of the electron-emitting device or the whole surface of the rear plate of the image display apparatus.

After the formation of the film 6, the image display apparatus shown in FIG. 1 can be manufactured by opposing the rear plate 7 and the face plate 11 to each other in a vacuum chamber to sealing them with the supporting frame 14 put between them. It is preferable to perform the sealing after exhausting the inside of the vacuum chamber by an exhausting apparatus which does not use oil, such as an ion pump and a sorption pump while heating suitably, and by performing getter processing as the need arises, to make the inside to be an atmosphere of the pressure within almost a range from $1.3\times10^{-3}$ to $1.3\times10^{-5}$ Pa in which organic materials are sufficiently little.

The image display apparatus of the present invention can be used also as an image display apparatus as an optical printer configured by using a photosensitive drum besides a display of a television broadcast and displays of a television conference system, a computer and the like.

EXAMPLES

Although the present invention will be described in detail hereafter by means of concrete examples, the present invention is not limited to these examples, and the present invention also includes those in which the substitution and the change of design of each element are performed within the scope in which the objects of the present invention can be attained.

Example 1

First, Pt paste was printed by an offset printing method on a substrate 1 (in size of 350×300 mm, and in thickness of 5 mm) comprising glass on which an $SiO_2$ layer was formed, and the Pt paste was heated to be burned to form the device electrodes 2 and 3 having a thickness of 50 nm on the substrate 1. Moreover, Ag paste was printed by the screen printing method, and the Ag paste was heated to be burnt to form the Y-direction wiring 9 (composed of 240 wires) and the X-direction wiring 10 (composed of 720 wires). Insulating paste was printed at the intersection parts of the Y-direction wiring 9 and the X-direction wiring 10 by the screen printing method, and the insulating paste was heated to be burnt to form an insulating layer.

Next, palladium complex solution was dripped by means of an injection apparatus of a bubble jet (registered trademark) method between the device electrodes 2 and 3. The dripped palladium complex solution was heated at 350° C. for 30 minutes to form the electroconductive film 4 composed of fine particles of palladium monoxide. The film thickness of the electroconductive film 4 was 20 nm.

The electron source substrate 1 which has the device structure composed of the pair of device electrodes 2 and 3 and an electroconductive film 4 spanning the region between the device electrodes 2 and 3 before the formation of the electron-emitting region 5 and has the matrix wiring composed of the Y-direction wiring 9 and the X-direction wiring 10 was produced.

In the state in which the ends of the Y-direction wiring 9 and the X-direction wiring 10 were taken out to be exposed as electrodes around the electron source substrate 1, a lid in the shape of a hood was put on the substrate 1 to cover the whole of the substrate 1, and the inside of the lid was exhausted to about $1.33\times10^{-1}$ Pa with a vacuum pump (here a scroll pump). After that, the temperature of the substrate 1 was raised up to 120° C. by using a heater for pipe arrangement and a heater for the electron source substrate 1 in order to remove the moisture which is considered to adhere to the pipe arrangement of the exhausting apparatus and to the electron source substrate 1. Then, the temperature was held for two hours, and was gradually cooled to the room temperature.

After the temperature of the electron source substrate 1 returned to the room temperature, the space in the lid shaped to be the hood was exhausted with the vacuum pump until the pressure in the lid reached the pressure of $2\times10^{-3}$ Pa. Furthermore, a nitrogen gas to which 2% of hydrogen was mixed was introduced, and a voltage was applied from an external power supply to the ends of the Y-direction wiring 9 and the X-direction wiring 10 which were taken out from the hood-like lid and ware exposed as electrode. Then, energization was performed between the device electrodes 2 and 3, and thereby the electron-emitting region 5, which was the fissure in a state of electrically high resistance, was formed in the electroconductive film 4. The voltage waveform of forming was set as the waveforms shown in FIG. 3A, and the pulse width T1 was set to be 0.1 msec, and the pulse interval T2 was set to be 10 msec, and further the peak value was set to be 10 V in the present example.

Successively, activation processing was performed using the lid in the shape of the hood. A pulse voltage was repeatedly applied from the outside to the device electrodes 2 and 3 through the X-direction wiring 10 and the Y-direction wiring 9 similarly to the above-mentioned forming. At the present process, trinitrile was used as the source of carbon to be introduced into the vacuum space between the lid in the shape of the hood and the substrate 1 through a slow leak valve to keep the pressure therein of $1.3\times10^{-4}$ Pa. The voltages to be applied were set to have the waveforms as shown in FIG. 4A. The pulse width T1 was set to be 1 msec, and the pulse interval T2 was set to be 10 msec, and further the peak values were set to be 16 V.

At the time point when the device current reached almost saturation after about 60 minutes, the energization was stopped, and the slow leak valve was closed, and further the activation processing was ended.

Next, an image display apparatus was produced using the electron source substrate 1 obtained by the above processes.

First, the rear plate 7 on which the electron source substrate 1 and the supporting frame 14 were fixed, and the face plate 11 on which the phosphor 12 and the metal-back 13 were formed were introduced into a vacuum consistent processing apparatus. On the supporting frame 14, indium for joining the face plate 11 and the rear plate 7 was arranged beforehand. Incidentally, the vacuum consistent processing apparatus was set to possess a mechanism capable of heating both the rear plate 7 and the face plate 11 independently, and further to be able to change the distance between the both of them arbitrarily by a vertical drive mechanism.

The face plate 11 and the rear plate 7 which had been set in the above-mentioned vacuum consistent processing apparatus was baked at 350° C. in the state in which the interval between both of the plates 11 and 7 was distant enough, and then the degassing of the face plate 11 and the rear plate 7 was performed. After that, the temperatures of the face plate 11 and the rear plate 7 were cooled down to 180° C. Then, the getter material of barium in the shape of a ribbon was energized to flash toward the face plate 11, and the getter material was deposited. The film thickness of the deposition of the barium was set to be about 30 nm. The barium film on the metal-back 13 aimed at carrying out absorbing and exhausting the remaining gas in the panel after an end of the seal bonding process to keep the pressure in the panel to be low.

After that, similarly to the above, the getter material of barium in the shape of a ribbon was conducted to flash and the same barium is formed on the rear plate 7. To reduce the deposition speed at this time, the deposition was made to be a film thickness of about 2 nm on the whole surface of the rear plate 7 by decreasing an amount of electric current upon the flash to shorten the deposition time.

After the barium was deposited on the face plate 11 and the rear plate 7 in the way described above, the interval between both the plates 11 and 7 was gradually brought closer, and a load was applied to the face plate 11 and the rear plate 7 until they became at the distance regulated by the height of the spacers (not shown). Then, the face plate 11 and the rear plate 7 were joined at the portion where the indium had been arranged beforehand on the supporting frame 14. The temperature was cooled down to the room temperature after the end of the junction, and the image display apparatus which was sealed to the vacuum was thus completed.

When a driver was connected to the image display apparatus obtained in this way and the characteristic evaluation of the electron-emitting device 8 and a test pattern display were performed, the electron discharging efficiency in early stages per the electron-emitting device 8 was 1.3% and the discharge current at the early stages was 15 microamperes. Moreover, the image display apparatus kept almost a constant electron discharging efficiency also after a 5000-hour drive, and no changes were found in the absolute values of the discharge currents, either. Furthermore, since no rises in the discharge currents and also no rises of the electron discharging efficiency were found in the present panel to any display patterns, the homogeneity at the early stages was continuing to be kept.

Comparison Example 1

For confirming the effects of the Example 1, an image display apparatus using a rear plate 7 which did not deposit the barium was produced.

The electron discharging efficiency in early stages of the obtained image display apparatus was 0.8%, which was about a half of that of the Example 1, and the discharge current in the early stages was 3 microampere, which was about one fifth of that of the Example 1. Moreover, the discharge current of a white display portion after a 5000-hour drive increased to about 3 times of that of the early stages, and the electron discharging efficiency also rose up to about 1.2 times of that of the early stages. On the other hand, since the characteristic of a black display portion did not changed from that at the early stages after the elapse of 5000 hours, a large luminance distribution was produced in the display area of one image forming apparatus.

Example 2

After the deposition of the barium onto the face plate 11 in the Example 1, the getter material of titanium was provided as an adjunct on the barium film to be a thickness of 50 nm by the RF sputtering method. Moreover, only the titanium was provided to be a thickness of 3 nm on the rear plate 7 without forming the barium film. To control the thickness of the titanium material, the deposition rate was suppressed to about 0.1 nm/s to form the titanium film by decreasing RF power and increasing the pressure upon the sputtering. An image display apparatus was produced similarly to the Example 1 except for the respects described above.

As a result, the discharge current at early stages was twice as much as that of the conventional configuration, and the efficiency was also twice as much as that of the conventional configuration. The characteristics were kept after the elapse of 5000 hours.

Example 3

An image display apparatus was produced similarly to the Example 1 except for using a face plate on which the aluminum metal-back 13 was exposed without deposited barium as the face plate 11, and except for using a rear plate on the whole surface of which aluminum was deposited to be a thickness of 2 nm as the rear plate 7.

In this case, the deposition of the aluminum having the 2 nm thickness onto the whole surface of the rear plate 7 was performed by an electron beam deposition process in a vacuum container immediately before combining the face plate 11 and the rear plate 7.

As a result, the electron discharging efficiency at early stages was 1.1%, the discharged current at the early stages was 4.5 microampere, and no changes were generated after the elapse of 5000 hours.

Example 4

Using a technique similar to the Examples 1, 2 and 3, a plurality of first, second and third image display apparatus, in which the films of barium, titanium and aluminum, respectively, are provided to be a thickness of 0.2 nm on the whole surface of the rear plate 7, were produced.

As a result, the produced image display apparatuses indicated the following respective initial electron discharging efficiency characteristics and initial discharge current characteristics: for the first image display apparatus with the barium film being provided, 1.2% in electron discharge efficiency and 6.0 μA in discharge current; for the second image display apparatus with the titanium film being provided, 1.0% in electron discharge efficiency and 4.5 μA in discharge current; and for the third image display apparatus with the aluminum film being provided, 1.0% in electron discharging efficiency and 4.5 μA in discharge current. Thus, in any of the first, second and third image display apparatuses, the electron charging efficiency and the discharge current were not almost varied.

Using a technique similar to the Example 4, a plurality of fourth, fifth, and sixth image display apparatuses, in which the films of barium, titanium and aluminum, respectively, are provided to be a thickness of 4.5 nm on the whose surface of the rear plate 7, were produced.

As a result, the produced image display apparatuses indicated the following initial electron discharging efficiency characteristics and initial discharge current characteristics: for the fourth image display apparatus with the barium film being provided, 1.0% in electron discharging efficiency and 13 μA in discharge current; for the fifth image display apparatus with the titanium film being provided, 1.0% in electron discharging efficiency and 4.0 μA in discharge current; and for the sixth image display apparatus with the aluminum film being provided, 1.0% in electron discharging efficiency and 4.5 μA in discharge current. Thus, in any of the fourth, fifth and sixth image display apparatuses, the electron discharging efficiency and the discharge current were not almost varied.

Comparison Example 2

Using a technique similar to the Example 4, another plurality of image display apparatuses in which the films of barium, titanium and aluminum, respectively, are provided to be a thickness of about 5.0 nm on the whole surface of the rear plate 7, were produced. And, when the drive circuit is connected to each of these image display apparatues and the characteristics evaluation of the electron-emitting device 8 and a test pattern display were performed, in the case of any material a short circuit was yielded, which did not result in obtaining the desired characteristics due to the extreme lowering of efficiency or the extinction of electron-emitting functions.

TABLE 1

| DEPOSITION MATERIALS | FILM | INITIAL CHARACTERISTICS | | CHARACTERISTICS AFTER ELAPSE OF 5000 HOURS | |
|---|---|---|---|---|---|
| ON SIDE OF REAR PLATE | THICKNESS (nm) | DISCHARGE CURRENT (μA) | EFFICIENCY (%) | DISCHARGE CURRENT (μA) | EFFICIENCY (%) |
| absent | 0 | 3.0 | 0.8 | 9.0 | 1.0 |
| barium | 0.2 | 6.0 | 1.2 | 6.0 | 1.2 |
| | 2.0 | 15.0 | 1.3 | 15.0 | 1.3 |
| | 4.5 | 13.0 | 1.0 | 13.0 | 1.0 |
| | 5.0 | fault occurrence | | | |
| titanium | 0.2 | 4.5 | 1.0 | 4.5 | 1.0 |
| | 3.0 | 6.0 | 1.5 | 6.0 | 1.5 |
| | 4.5 | 4.0 | 1.0 | 4.0 | 1.0 |
| | 5.0 | fault occurrence | | | |
| aluminum | 0.2 | 4.5 | 1.0 | 4.5 | 1.0 |
| | 2.0 | 5.0 | 1.1 | 5.0 | 1.1 |
| | 4.5 | 4.5 | 1.0 | 4.5 | 1.0 |
| | 5.0 | fault occurrence | | | |

This application claims priority from Japanese Patent Application No. 2004-117663 filed on Apr. 13, 2004, which is hereby incorporated by reference herein.

What is claimed is:

1. An image display apparatus including a rear plate and a face plate disposed opposite to each other, said rear plate being equipped with a plurality of electron-emitting devices, each provided with a pair of electrodes and an electroconductive film including an electron-emitting region disposed between said electrodes, said face plate being equipped with a phosphor for displaying an image by being irradiated by electrons from said electron-emitting devices and a metal film exposed above said phosphor, said image display apparatus comprising:

a metal film being formed on each of said electroconductive films of said plurality of electron-emitting devices to have a thickness in a range from 0.2 nm to 4.5 nm, wherein a metal of said film formed on each of said electroconductive films is the same metal as a metal of said metal film exposed above said phosphor.

2. The image display apparatus according to claim 1, wherein said metal film exposed above said phosphor is a metal-back formed on the surface of said phosphor.

3. The image display apparatus according to claim 2, wherein a constituent material of said metal-back is aluminum.

4. The image display apparatus according to claim 1, wherein said metal film above said phosphor is a film comprising a getter material formed on a surface of a metal-back formed on the surface of said phosphor.

5. The image display apparatus according to claim 4, wherein the getter material is barium or titanium.

6. An image display apparatus including a rear plate and a face plate disposed opposite to each other, said rear plate being equipped with a plurality of electron-emitting devices, each provided with a pair of electrodes and an electroconductive film including an electron-emitting region disposed between said electrodes, said face plate being equipped with a phosphor for displaying an image by being irradiated by electrons from said electron-emitting devices and a metal compound film exposed above said phosphor, said image display apparatus comprising:

a metal compound film formed on each of said electroconductive films of said plurality of electron-emitting devices to have a thickness in a range from 0.2 nm to 4.5 nm, wherein a metal compound material of said metal compound film formed on each of said electroconductive films is the same metal compound material as a metal compound material of said metal compound film exposed above said phosphor.

7. The image display apparatus according to claim 6, wherein said metal compound film exposed above said phosphor is a metal-back formed on the surface of said phosphor.

8. The image display apparatus according to claim 7, wherein a constituent material of said metal-back is a metal compound including aluminum as its principal component.

9. The image display apparatus according to claim 6, wherein said metal compound film above said phosphor is a film comprising a getter material formed on a surface of a metal-back formed on the surface of said phosphor.

10. The image display apparatus according to claim 9, wherein the getter material is a metal compound including barium or titanium as its principal component.

* * * * *

UNITED STATES PATENT AND TRADEMARK OFFICE

CERTIFICATE OF CORRECTION

PATENT NO. : 7,271,529 B2
APPLICATION NO. : 11/097332
DATED : September 18, 2007
INVENTOR(S) : Toshihiko Takeda et al.

It is certified that error appears in the above-identified patent and that said Letters Patent is hereby corrected as shown below:

ON THE TITLE PAGE ITEM [75]:

Inventors, "Toshihiko Takeda, Kanagawa-ken (JP); Keisuke Yamamoto, Kanagawa-ken (JP); Tamaki Kobayashi, Kanagawa-ken (JP); Takuto Moriguchi, Kanagawa-ken (JP)" should read --Toshihiko Takeda, Yokohama (JP); Keisuke Yamamoto, Yamato (JP); Tamaki Kobayashi, Isehara (JP); Takuto Moriguchi, Atsugi--.

COLUMN 2:

Line 56, "as an" should read --as a--.

COLUMN 5:

Line 9, "each of an" should read --on each of--.

COLUMN 7:

Line 35, "FIGS. 2a" should read --FIGS. 2A--.

COLUMN 8:

Line 11, "from" should read --for--;
Line 37, "are" should read --is--; and
Line 40, "increasing" should read --increase--.

COLUMN 9:

Line 48, "one" should read --ones--.

COLUMN 12:

Line 32, "ware" should read --were--

UNITED STATES PATENT AND TRADEMARK OFFICE

CERTIFICATE OF CORRECTION

PATENT NO. : 7,271,529 B2
APPLICATION NO. : 11/097332
DATED : September 18, 2007
INVENTOR(S) : Toshihiko Takeda et al.

It is certified that error appears in the above-identified patent and that said Letters Patent is hereby corrected as shown below:

COLUMN 13:

Line 6, “was” should read --were--; and
Line 67, “changed” should read --change--.

COLUMN 14:

Line 16, “for the respects” should read --in the respect--; and
Line 66, “whose” should read --whole--.

Signed and Sealed this

Twentieth Day of May, 2008

JON W. DUDAS
*Director of the United States Patent and Trademark Office*